US011384318B2

(12) United States Patent
Sijmons et al.

(10) Patent No.: US 11,384,318 B2
(45) Date of Patent: Jul. 12, 2022

(54) LAUNDRY PERFUMING COMPOSITION

(71) Applicant: Zobele Holding S.P.A., Trento (IT)

(72) Inventors: Jessica Sijmons, Barcellona (ES); Giovanni Carrara, Trento (IT)

(73) Assignee: ZOBELE HOLDING S.p.A., Trento (IT)

( * ) Notice: Subject to any disclaimer, the term of this patent is extended or adjusted under 35 U.S.C. 154(b) by 108 days.

(21) Appl. No.: 16/958,760

(22) PCT Filed: Dec. 13, 2018

(86) PCT No.: PCT/IB2018/060029

§ 371 (c)(1),
(2) Date: Jun. 29, 2020

(87) PCT Pub. No.: WO2019/130145

PCT Pub. Date: Jul. 4, 2019

(65) Prior Publication Data

US 2020/0347325 A1 Nov. 5, 2020

(30) Foreign Application Priority Data

Dec. 29, 2017 (IT) ..... 102017000151150

(51) Int. Cl.

| | |
|---|---|
| ***C11D 3/50*** | (2006.01) |
| ***C11D 3/12*** | (2006.01) |
| ***C11D 3/20*** | (2006.01) |
| ***C11D 3/32*** | (2006.01) |
| ***C11D 3/40*** | (2006.01) |
| ***C11D 11/00*** | (2006.01) |

(52) U.S. Cl.

CPC ..... *C11D 3/505* (2013.01); *C11D 3/126* (2013.01); *C11D 3/2093* (2013.01); *C11D 3/323* (2013.01); *C11D 3/40* (2013.01); *C11D 11/0017* (2013.01)

(58) Field of Classification Search

CPC ..... A61Q 13/00; A61Q 19/10; A61Q 5/02; A61Q 15/00; A61Q 5/06; A61Q 11/00; C11D 17/0039; C11D 3/505; C11D 3/507; C11D 3/50; C11D 17/041; C11D 17/0034; A61K 8/11

See application file for complete search history.

(56) References Cited

U.S. PATENT DOCUMENTS

| | | | | |
|---|---|---|---|---|
| 4,576,737 | A * | 3/1986 | Johnson | A23L 27/72 512/4 |
| 8,399,395 | B2 | 3/2013 | Dreja et al. | |
| 2007/0111919 | A1 * | 5/2007 | Boerefijn | C11D 3/505 510/445 |
| 2017/0226690 | A1 | 8/2017 | Brain et al. | |
| 2017/0369824 | A1 * | 12/2017 | Sunder | C11D 17/043 |

FOREIGN PATENT DOCUMENTS

| | | | |
|---|---|---|---|
| WO | 02/41864 | A1 | 5/2002 |
| WO | 2016/018271 | A1 | 2/2016 |

OTHER PUBLICATIONS

International Search Report, European Patent Office, dated Apr. 3, 2019.

Written Opinion, International Searching Authority, European Patent Office, dated Apr. 3, 2019.

* cited by examiner

*Primary Examiner* — John R Hardee

(74) *Attorney, Agent, or Firm* — Bay State IP, LLC

(57) ABSTRACT

Laundry perfuming composition of the type comprising water-soluble, non-polymeric crystal salts in combination with a fragrance in free form, wherein said crystal salts are furthermore provided with at least a partial coating layer consisting of a fragrance in microcapsules, and such fragrance in free form is absorbed in said coating layer.

14 Claims, No Drawings

LAUNDRY PERFUMING COMPOSITION

CROSS REFERENCE TO RELATED APPLICATION

This application is for entry into the U.S. National Phase under § 371 for International Application No. PCT/IB2018/060029 having an international filing date of Dec. 13, 2018, and from which priority is claimed under all applicable sections of Title 35 of the United States Code including, but not limited to, Sections 120, 363, and 365(c) and which in turn claims priority under 35 USC 119 to Italian Patent Application No. 102017000151150 filed on Dec. 29, 2017.

FIELD OF THE INVENTION

The present invention relates to a perfuming laundry composition suitable for providing both a rapid fragrance release and a continued perfuming action lasting for weeks.

BACKGROUND OF THE ART

In recent years, a new type of laundry care product has been introduced on the market, consisting of solid substances, in the form of particles, put into a washing machine during a washing cycle. The main and often only function of this product is to add a pleasant scent to clothing. Thanks to this, the consumer can choose the fragrance character and intensity, regardless of the detergent and fabric softener quality and dosage.

Current perfuming compositions can be classified in two families depending on the material which they are mainly consisting of: non-polymeric crystalline materials or pellet polymeric materials.

Non-polymeric crystalline materials generally consist of salts crystals or urea crystals in particles. The fragrance addition does not alter the particles morphology since said fragrance is usually added only as a surface coating of the same. The main advantage of this type of perfuming composition is that the carrier substance has a very high dissolution rate, even in cold water. In addition to this, both raw materials and production processes have low costs.

On the other hand, pellet polymeric materials generally consist of water-soluble polymers which are mixed in bulk with fragrances, often in form of microcapsules, and then converted into granules or pellets. Water-soluble polymers may include, inter alia, polyethylene glycol or natural soaps. The main advantage of the polymeric materials is to allow the incorporation of fragrances in form of microcapsules, which is a particularly interesting packaging type.

As a matter of fact, microcapsules prevent fragrance evaporation during the washing and drying operations and when clothes remain stored in the wardrobe too, while they release the fragrance by microcapsules breakage, when garments are handled or worn. Thus, the presence of fragrance microcapsules in the perfuming composition makes it possible to achieve a long-lasting perfuming effect.

So far, however, no perfuming compositions have been conceived and offered in the market, showing at the same time both advantages that the currently known perfuming compositions separately exhibit, i.e. the crystalline materials high solubility with the consequent immediate perfuming effect, and the long-lasting perfuming effect of polymeric materials containing microcapsules.

It is therefore an object of the present invention to provide a composite perfuming composition which exhibits these features and can be manufactured with a simple and inexpensive process.

In order to solve this problem, a first object of the invention is to provide a composition having the features indicated above, in the form of an easy to dose, free-flowing, dry powder.

Another object of the invention is then to provide a composition which is stable over time and, in particular, do not show component separation during storage and use.

SUMMARY OF THE INVENTION

This problem is solved, and these objects achieved, by means of a perfuming laundry composition as defined in claim 1, and a perfuming composition manufacturing method as defined in claim 13. Other preferred features of the laundry perfuming composition according to the invention are defined in the secondary claims.

Further features and advantages of the laundry perfuming composition according to the present invention will in any case become more evident from the following detailed description of preferred embodiments thereof, illustrated in the attached Examples. These embodiments are precisely by way of example only, and therefore must not be intended as limiting in any way the scope of the invention.

DETAILED DESCRIPTION OF THE INVENTION

In order to solve the above mentioned problem by means of a laundry perfuming composition which is easy to produce and convenient to use, the present inventors devised for adding fragrances in microcapsules, free of supporting polymeric material, to the water-soluble crystalline materials, typical of the first group of known perfuming compositions, in such a proportion that the crystalline material forms the matrix of the composite formulation thus obtained. As a matter of fact, dry microcapsules are made to adhere to said matrix through a suitable adhesive agent. Preferably, dry microcapsules are also previously mixed with a free fragrance.

Thanks to this particular formulation, the laundry perfuming composition of the present invention exhibits the desired properties of a controlled fragrance release over time, i.e. an immediate fragrance release upon the washing, due to the fragrance in free form which dissolves in the washing water, and a delayed fragrance release, when linen or clothes are used, due to the breakage of the microcapsules trapped therein. The perfuming composition of the invention is furthermore perfectly stable over time and does not undergo component separation during storage, transport and use. Finally, the perfuming composition of the invention is in the form of a free-flowing dry powder, free from lump formation phenomena (anticaking property), thus allowing that a convenient and effective dosage be made by the user.

The laundry perfuming composition of the invention which releases a desired fragrance in a controlled way over time contains, as a main component, water-soluble non-polymeric salts in crystalline form, as a carrier of the other components of the formulation. Due to aesthetic reasons, the crystal particle size of said salts is preferably as uniform as possible. Here and in the following, the term "salts" must be intended extensively to include any water-soluble non-polymeric substance in crystalline form; for example, all inorganic and organic crystal salts, such as urea, fall within this definition.

At least a partial coating layer is then formed on said main component, i.e. the water-soluble non-polymeric salts in crystalline form, said coating layer consisting of a mixture of the desired fragrance in free form and in microcapsules. This coating step of the main component is particularly critical in order to obtain a final composition having the desired features of stability over time in respect of component separation. It is required, in fact, to achieve a high adhesion to the crystal salts of the powder mixture made with the fragrance in free form and the fragrance in microcapsules, in order to avoid a detachment over time of said powder mixture from the carrier crystal salts, caused by vibrations during transport or by user handling, which makes the fragrance persistence ineffective or less effective.

The final composition obtained upon an accurate mixing of the above-mentioned components consists in a dry, free-flowing, powder product, said product being highly soluble in cold water and provided with an excellent perfume persistence lasting for several weeks after use.

All percentages of the various components of the perfuming composition of the invention, as specified below, are to be intended as percentages by weight with respect to the composition total weight.

The water-soluble non-polymeric salts in crystalline form i.e. the composition main component, constitute, as already said above, the same matrix of the composition; their percent amount is therefore not particularly critical, provided that their overall surface area is sufficient to adequately perform the carrier function supporting the other components. Preferably the percent amount of the water-soluble non-polymeric salts in crystalline form is higher than 60% and, more preferably, higher than 80%.

All types of perfumed natural and synthetic oils can be used as a fragrance in free form, in an amount ranging from 1% to 10%.

As a fragrance in microcapsules, it is essential for the purposes of the invention using microcapsules in the form of dry powder rather than in aqueous dispersion as normally available on the market. This measure is necessary both to avoid the water-soluble non-polymeric salts from undergoing a partial dissolution during the manufacturing process of the composition, and to allow a rapid absorption of the fragrance in free form on the microcapsules surface. Generally, the fragrance in microcapsules is used in an amount ranging from 0.5% to 10%, and preferably from 4% to 6%, depending on the amount of fragrance in free form. as a matter of fact, the final mixture of the fragrance in microcapsules with the fragrance in free form must nevertheless result in a dry mixture.

As an adhesive agent, a component selected from glycol ethers (as the ones available under Dowanol DPM or Dowanol TPM trademarks from The Dow Chemical Company), natural rubbers (as the ones available under Genu Gum CI-125 trademark), isoalkanes (as the ones available under Isopar trademark) and isopropyl myristate, can be used. An isopropylidene glycerol-based product (as the one available under Agueo Clean Multi trademark from Surfachem) can be used as a further alternative. The adhesive agent is typically used in an amount ranging from 0.5% to 5%, and preferably from 0.8% to 1%.

If a special colour is desired for the product, a water-based dye, i.e. water-soluble dye, of the type approved for laundry washing applications can be added to the mixture.

Finally, in order to render the final powder product perfectly dry and therefore fee flowing and free from lump formation during storage in packaging, the further addition of an anticaking agent may be useful. Silica fume (as the one available under Cab-O-Sil trademark from Cabot Corporation, or under Aerosil trademark from Evonik), sodium silicate or clay are exemplary anticaking agents.

Preferred Embodiments

The perfuming composition of the invention will now be illustrated, without being limited thereto, by the following Examples, where some exemplary perfuming compositions are shown.

EXAMPLES

Example 1

A pink perfuming composition of crystal salts releasing a fragrance in combination with a fragrance in microcapsules has the following composition:

| # | Ingredient | Amount (%) |
|---|---|---|
| 1 | water-soluble, non-polymeric crystal salts | 87.67 |
| 2 | Adhesive solvent (isopropyl myristate) | 0.80 |
| 3 | Fragrance in free form | 5.00 |
| 4 | Water-based dye | 0.03 |
| 5 | Fragrance in microcapsules (powder) | 6.50 |
| | Total | 100.00 |

For manufacturing the perfuming composition of the invention, components 1 and 2 are initially mixed. Mixing takes place for a short time, enough to thoroughly moisten all the crystal salts with the adhesive solvent.

Separately, components 3 and 4 are mixed together, until a homogeneous colour of the mixture is obtained; then, component 5 of the fragrance in microcapsules is added, stirring thoroughly until the fragrance in free form is evenly distributed on the microcapsules and absorbed thereon, thus resulting in a dry mixture.

The two pre-mixtures thus obtained are combined and mutually mixed for a short period of time, so as to obtain the adhesion of the microcapsules, together with the fragrance in free form absorbed thereon, to the surface of the water-soluble crystal salts.

Example 2

A pink perfuming composition of spherical urea pellets releasing a fragrance, in combination with a fragrance in microcapsules, has the following composition:

| # | Ingredient | Amount (%) |
|---|---|---|
| 1 | Spherical urea pellets | 87.67 |
| 2 | Adhesive solvent (Augeo Multi Clean) | 0.80 |
| 3 | Fragrance in free form | 5.00 |
| 4 | Water-based dye | 0.03 |
| 5 | Fragrance in microcapsules (powder) | 6.50 |
| | Total | 100.00 |

The manufacturing process of this perfuming composition is the same as that described in Example 1.

Example 3

A yellow perfuming composition of crystal salts releasing a fragrance in combination with a fragrance in microcapsules has the following composition:

| # | Ingredient | Quantità (%) |
|---|---|---|
| 1 | water-soluble, non-polymeric crystal salts | 82.67 |
| 2 | Adhesive solvent (isopropyl myristate) | 0.80 |
| 3 | Fragrance in free form | 5.00 |
| 4 | Water-based dye | 0.03 |
| 5 | Fragrance in microcapsules (powder) | 6.50 |
| 6 | Clay (bentonite) | 5.00 |
| | Total | 100.00 |

For manufacturing the perfuming composition of the invention, components 1 and 2 are initially mixed. Mixing takes place for a short time, enough to thoroughly moisten all the crystal salts with the adhesive solvent.

Separately, components 3 and 4 are mixed together, until a homogeneous colour of the mixture is obtained; then, component 5 of the fragrance in microcapsules is added, while thoroughly stirring. Component 6 is then gradually added, through continuous mixing, until a final dry mixture is obtained. In such a final dry mixture the fragrance in free form is evenly distributed on the microcapsules and absorbed thereon.

The two pre-mixtures thus obtained are combined and mutually mixed for a short period of time, so as to obtain the adhesion of the microcapsules, together with the fragrance in free form absorbed thereon, to the surface of the water-soluble crystal salts.

It is understood, however, that the invention should not be considered as limited to the specific compositions illustrated above, which are only exemplary embodiments thereof, but that different modifications are possible, all within the reach of a person skilled in the art, without departing from the scope of the invention, which is only defined by the attached claims.

The invention claimed is:

1. A laundry perfuming composition of the type comprising water-soluble, non-polymeric crystal salts in combination with a fragrance in free form characterised in that said crystal salts are furthermore provided with at least a partial coating layer comprising a fragrance in microcapsules, and the coating layer is bonded onto the crystal salts through an adhesive agent.

2. The laundry perfuming composition of claim 1, wherein said fragrance in free form is absorbed in said coating layer.

3. The laundry perfuming composition of claim 2, wherein said adhesive agent is selected from glycol ethers, natural gums, isoalkanes, isopropyl myristate and isopropylidene glycerol.

4. The laundry perfuming composition of claim 3, wherein the amount of said adhesive agent ranges from 0.5% to 5% by weight of the overall composition weight.

5. The laundry perfuming composition of claim 2, wherein said fragrance in free form consists of perfumed, natural or synthetic oils, whose amount ranges from 1% to 10% by weight of the overall composition weight.

6. The laundry perfuming composition of claim 2, wherein said water-soluble non-polymeric salts are selected from inorganic and organic crystal salts.

7. The laundry perfuming composition of claim 6, wherein the amount of said water-soluble non-polymeric salts is above 60% by weight of the overall composition weight.

8. The laundry perfuming composition of claim 2, wherein said fragrance in microcapsules is in the form of a dry powder.

9. The laundry perfuming composition of claim 8, wherein the amount of said fragrance in microcapsules ranges from 0.5% to 10% by weight of the overall composition weight.

10. The laundry perfuming composition of claim 2, containing also a water-based dye.

11. The laundry perfuming composition of claim 2, containing also an anti-caking agent selected from fumed silica, sodium silicate and clay.

12. The laundry perfuming composition of claim 1, wherein said water-soluble non-polymeric salts are urea.

13. A manufacturing method of the perfuming composition of claim 2, which comprises the steps of:

a. mixing said water-soluble non-polymeric crystal salts with said adhesive agent for a period of time enough to thoroughly moisten all the crystal salts, thus obtaining a first pre-mixture;

b. separately mixing said fragrance in free form with a water-based dye, until a second, evenly-coloured pre-mixture is obtained;

c. adding said fragrance in microcapsules to said second pre-mixture, mixing thoroughly until the fragrance in free form is evenly distributed and absorbed on the microcapsules, thus obtaining a third pre-mixture;

d. combining said first pre-mixture and said third pre-mixture and mixing them for a period of time until obtaining the adhesion of the microcapsules with added fragrance in free form to the crystal surface of said water-soluble non-polymeric salts.

14. The manufacturing method of claim 13, furthermore comprising the step of:

c1. gradually adding also an anti-caking agent, selected from the group consisting of fumed silica, sodium silicate, and clay, during the mixing operation of step c.

* * * * *